US010458177B1

(12) United States Patent
Steele et al.

(10) Patent No.: US 10,458,177 B1
(45) Date of Patent: Oct. 29, 2019

(54) METAL DOOR

(71) Applicants: Ryan D. Steele, Omaha, NE (US); Daniel C. Cullinane, Omaha, NE (US)

(72) Inventors: Ryan D. Steele, Omaha, NE (US); Daniel C. Cullinane, Omaha, NE (US)

(73) Assignee: OUTDOOR SPACES, INC., Omaha, NE (US)

( * ) Notice: Subject to any disclaimer, the term of this patent is extended or adjusted under 35 U.S.C. 154(b) by 0 days.

(21) Appl. No.: 15/916,803

(22) Filed: Mar. 9, 2018

(51) Int. Cl.

| | |
|---|---|
| ***E04C 2/54*** | (2006.01) |
| ***E06B 3/72*** | (2006.01) |
| ***E06B 3/76*** | (2006.01) |
| ***E06B 1/18*** | (2006.01) |
| ***E06B 3/70*** | (2006.01) |

(52) U.S. Cl.
CPC ..... *E06B 3/728* (2013.01); *E06B 1/18* (2013.01); *E06B 3/7001* (2013.01); *E06B 3/76* (2013.01); *E06B 2003/7049* (2013.01)

(58) Field of Classification Search
CPC ..... E06B 3/728; E06B 3/7001; E06B 1/18; E06B 3/76; E06B 2003/7049
USPC ..... 52/784.15
See application file for complete search history.

(56) References Cited

U.S. PATENT DOCUMENTS

| | | | | |
|---|---|---|---|---|
| 2,605,869 | A * | 8/1952 | Backman | E06B 3/365 16/248 |
| 3,222,833 | A * | 12/1965 | Woodrum | E06B 1/6015 403/295 |
| 3,299,596 | A * | 1/1967 | Neal | E06B 3/726 49/489.1 |
| 4,327,535 | A * | 5/1982 | Governale | E06B 3/5892 49/501 |
| 5,557,899 | A * | 9/1996 | Dube | E06B 3/221 49/DIG. 2 |
| 6,688,063 | B1 * | 2/2004 | Lee | E05B 9/08 49/501 |
| 6,972,100 | B2 * | 12/2005 | Minke | B28B 1/14 264/42 |
| 8,534,027 | B1 | 9/2013 | Cullinane et al. | |
| 8,656,684 | B1 | 2/2014 | Cullinane et al. | |
| 9,175,508 | B1 * | 11/2015 | Steele | E06B 3/72 |

* cited by examiner

*Primary Examiner* — Basil S Katcheves
(74) *Attorney, Agent, or Firm* — Milligan PC LLO

(57) ABSTRACT

A metal door including a hinge stile having upper and lower ends, a lock stile having upper and lower ends, a top rail extending between the upper ends of the hinge and lock stiles, a bottom rail extending between the lower ends of the hinge and lock stiles, and an intermediate rail extending between the hinge and lock stiles above the bottom rail. The hinge stile, the lock stile, the top rail, the bottom rail and the intermediate rail having a unique construction which creates a thermal break therein. The door is mounted in a jamb which also has a unique construction which creates a thermal break therein.

2 Claims, 11 Drawing Sheets

METAL DOOR

BACKGROUND OF THE INVENTION

Field of the Invention

This invention relates to a metal door and door jamb. More particularly, this invention related to a metal door wherein the hinge stile, the lock stile, the upper rail, the lower rail and the intermediate rail thereof have a thermal break therein to prevent the inside portion of the metal door from "frosting up" when the metal door is subjected to very cold temperatures. Even more particularly, this invention relates to a door jamb for the metal door which also has a thermal break therein.

Description of the Related Art

Many types of metal doors have been previously provided. The metal doors of the prior art are very durable and are resistant to forced entry attempts by burglars or the like. A problem associated with the metal doors of the prior art is encountered when the metal doors are subjected to cold temperatures. In such a situation, the inside portion of the metal doors of the prior art may "frost-up" when the metal doors are subjected to very cold temperatures. Further, the prior art door jambs are also subjected to "frost up" problems.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A metal door is disclosed which includes a vertically disposed hinge stile, a vertically disposed lock stile, a top rail which extends between the upper ends of the hinge and lock stiles, a bottom rail which extends between the lower ends of the hinge and lock stiles, and an optional intermediate rail which extends between the hinge and lock stiles above the bottom rail. The metal door may be a single door or a pair of metal doors arranged in a double door fashion. Each of the hinge stile, lock stile, top rail, bottom rail and the intermediate rail have a unique construction to provide a thermal break between the exterior and the interior sides of the door. The door or doors are mounted in a jamb which also has a thermal break provided therein. The thermal breaks of the stiles and rails prevent the interior of the door from frosting up.

A principal object of the invention is to provide an improved metal door.

A further object of the invention is to provide an improved metal door which has thermal breaks provided therein to prevent the inner side of the door from frosting up.

A further object of the invention is to provide an improved metal door which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
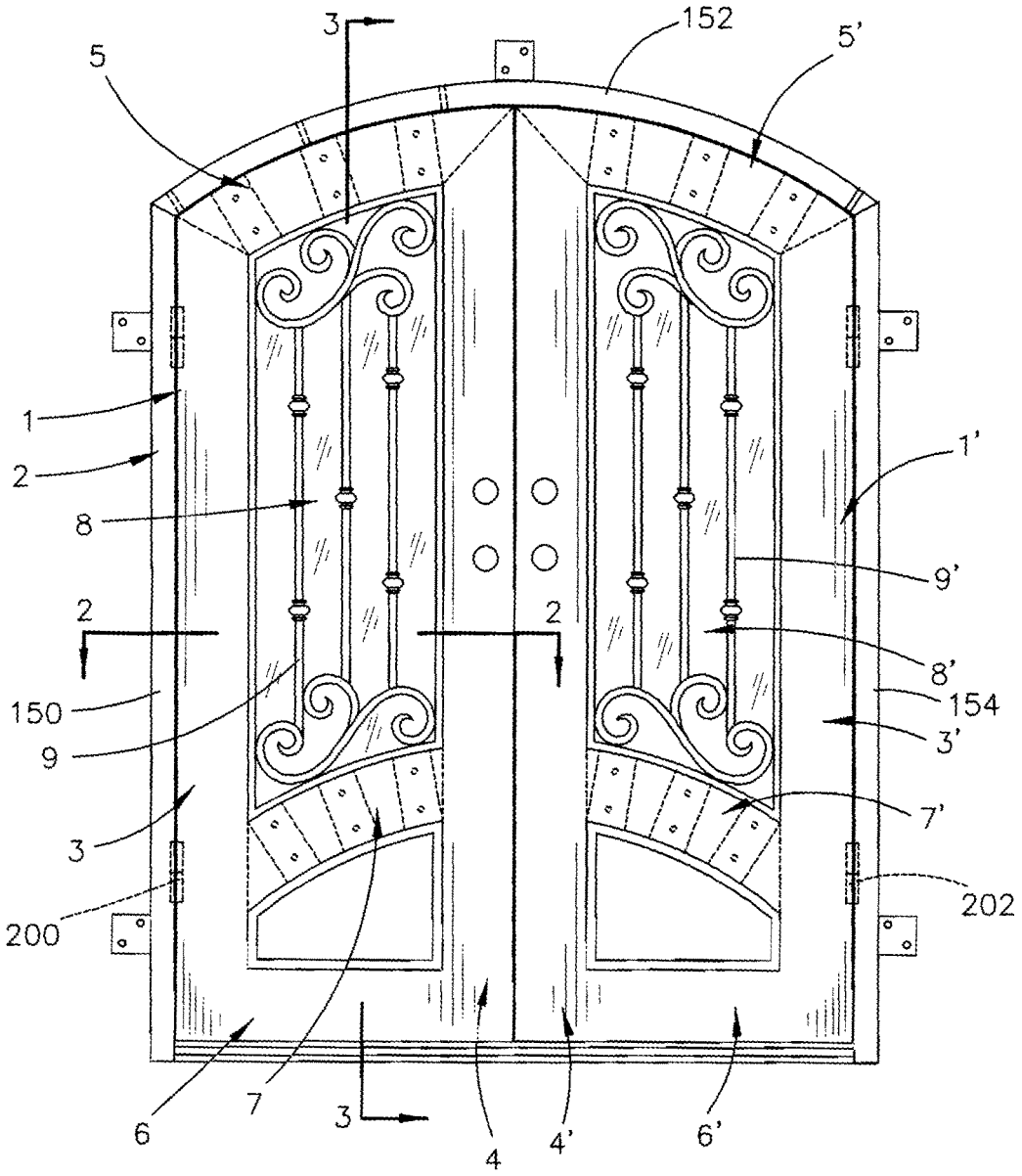
FIG. 1 is an exterior view of a pair of the metal doors of this invention mounted in a door jamb.
Figure 2:
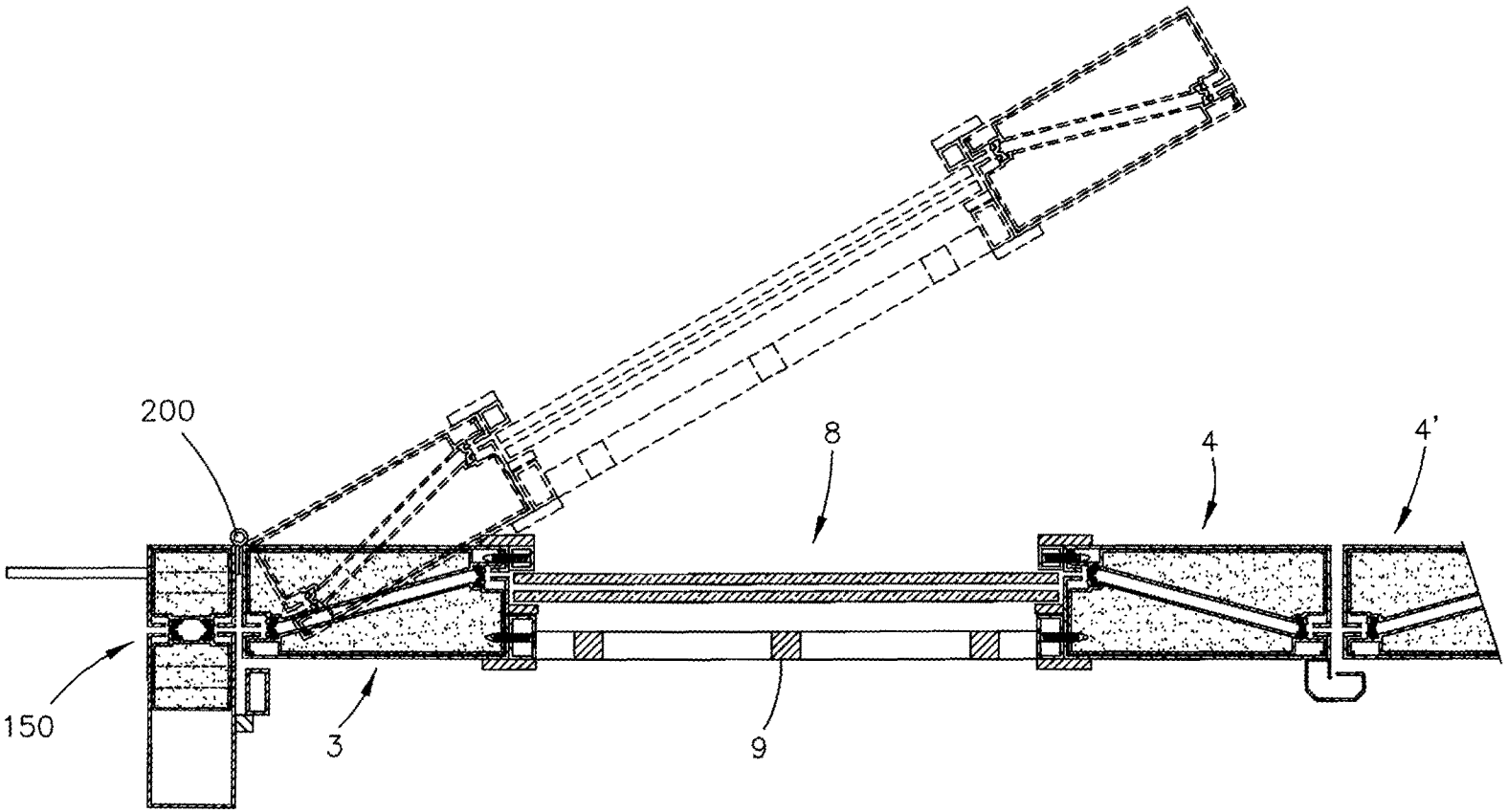
FIG. 2 is a partial sectional view as seen on lines 2-2 of FIG. 1.
Figure 3:
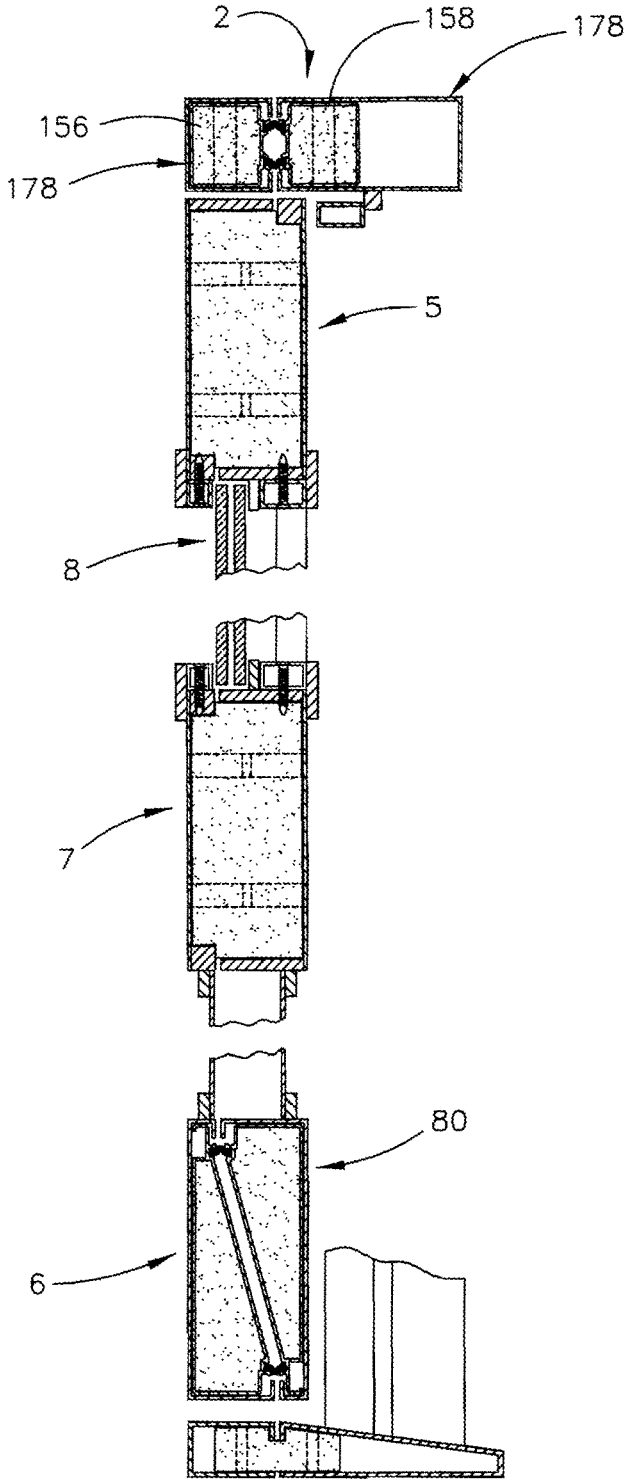
FIG. 3 is a partial sectional view as seen on lines 3-3 of FIG. 1.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 1 refers to the metal door of this invention which is mounted in a door frame jamb 2. The numeral 1' refers to a metal door which is identical to metal door 1 except that door 1' is a right-hand door and door 1 if a left-hand door as viewed from the exterior of the doors. Structure on door 1, which is identical to door 1, will be designated "". Door 1 includes a vertically disposed hinge stile 3, a vertically disposed lock stile 4, an arched or curved top rail 5, a bottom rail 6, an arched intermediate rail 7 which is positioned above the bottom rail and a central panel 8 in which an ornamental metal grill 9 is positioned.

Figure 4:
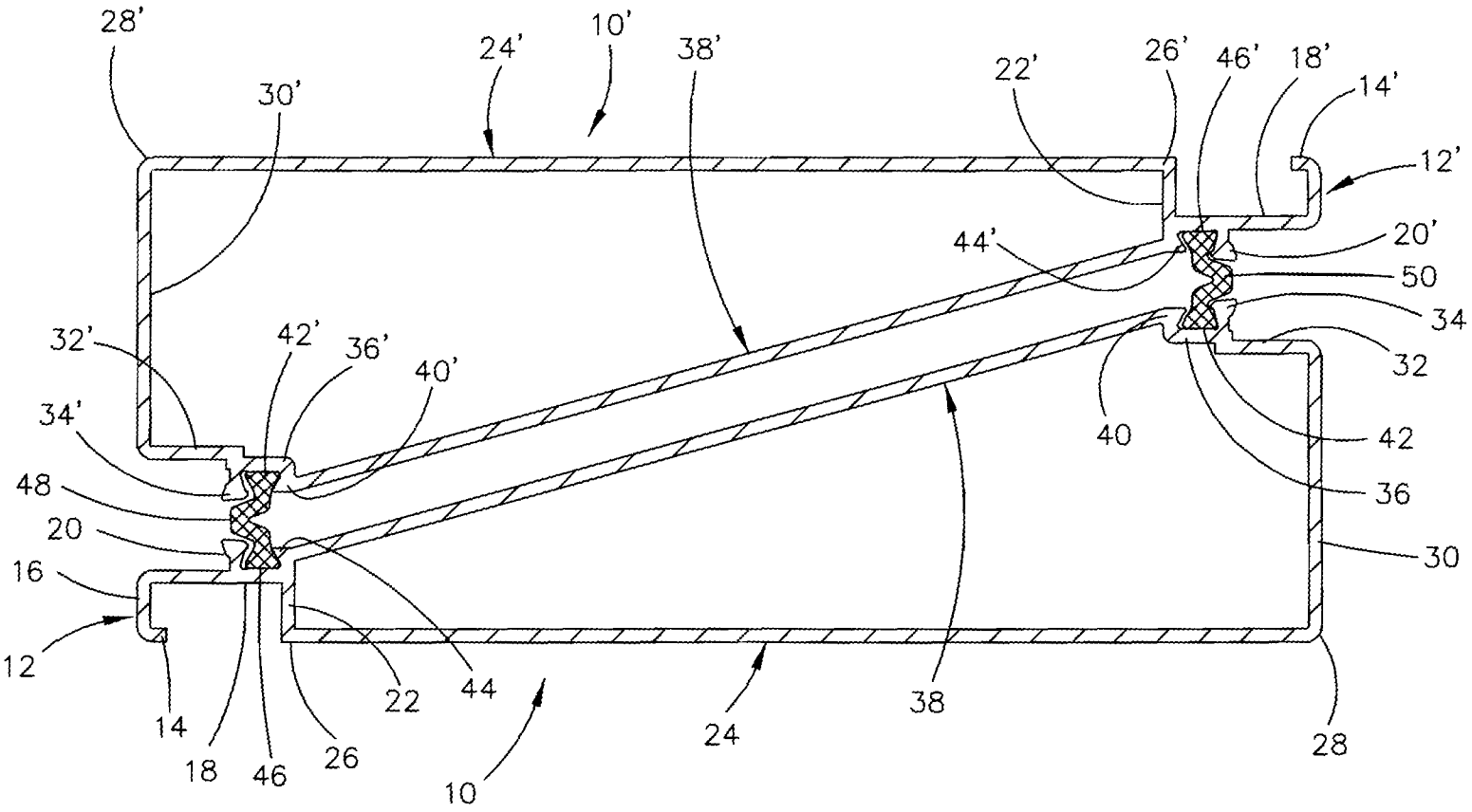
FIG. 4 is a sectional view of one of the stiles of this invention.

The numeral 10 refers to an elongated first aluminum extrusion with two of the aluminum extrusions 10 being joined together as will be described in detail hereinafter to form a door stile or rail. Extrusion 10 will be described as being horizontally disposed for purposes of description. Extrusion 10 includes an end portion 12 having a lip 14, a base portion 16 extending transversely inwardly from lip 14 and an elongated portion 18 which extends transversely from base portion 16. A mushroom-shaped member 20 extends transversely from elongated portion 18 as seen in FIG. 4. A transversely extending wall member 22 extends transversely outwardly from portion 18. An elongated outer wall member 24 extends transversely from member 22 and will be described as having ends 26 and 28. An end wall 30 extends transversely from end 28 of wall 24. A wall member 32 extends transversely from the inner end of end wall 30 and has a mushroom-shaped member 34 extending outwardly therefrom. Member 36 extends from member 34. An inner wall member 38 extends from member 36 and has a projection 40 formed therein which cooperates with the mushroom-shaped member 34 to form an elongated pocket or channel 42. The other end of wall member 38 has a projection 44 formed therein which cooperated with the mushroom-shaped member 20 to form an elongated pocket or channel 46.

Figure 8:
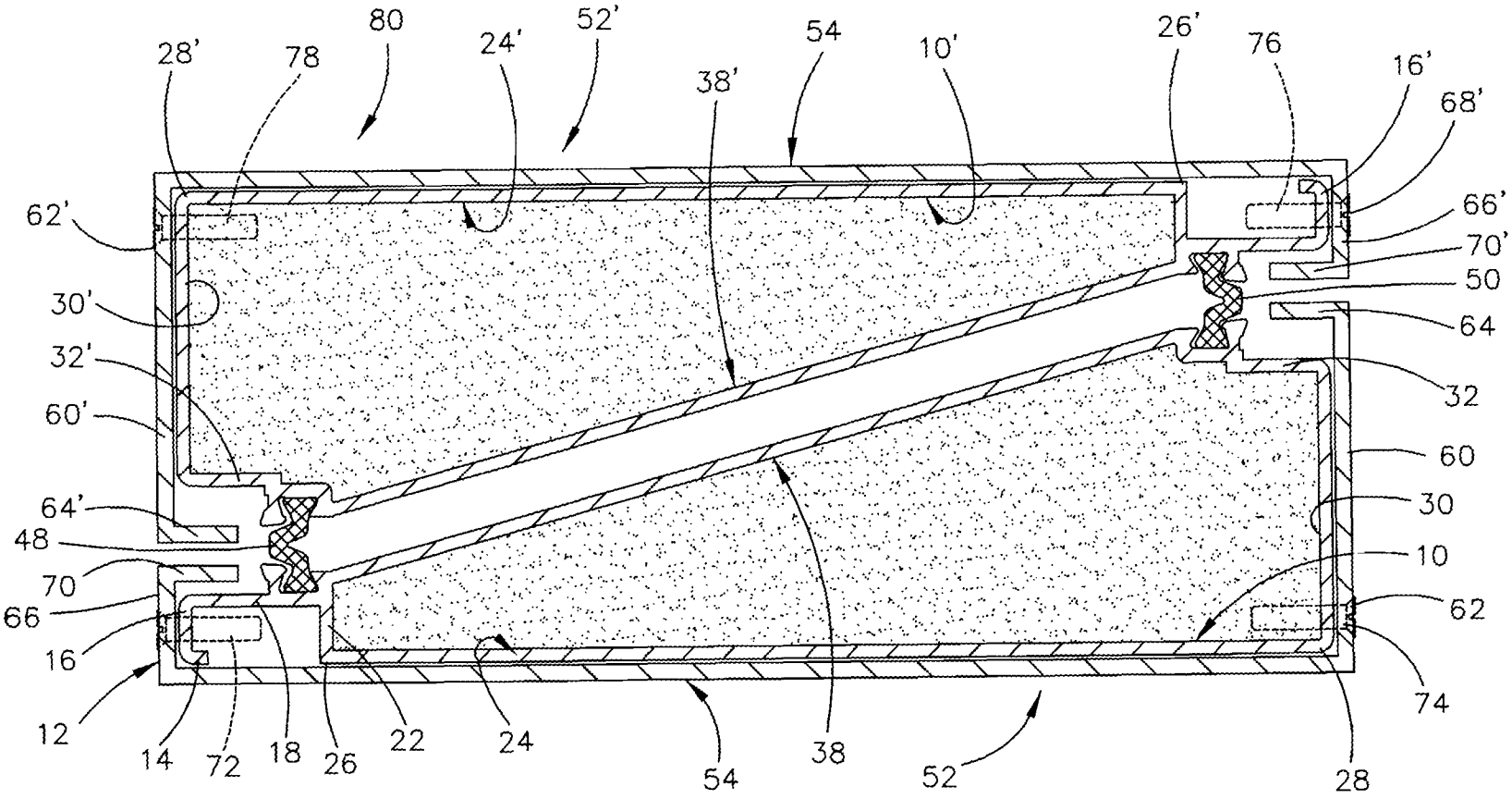
FIG. 8 is a sectional view similar to FIG. 4 except that the metal skins have been placed on the stile.
Figure 9:
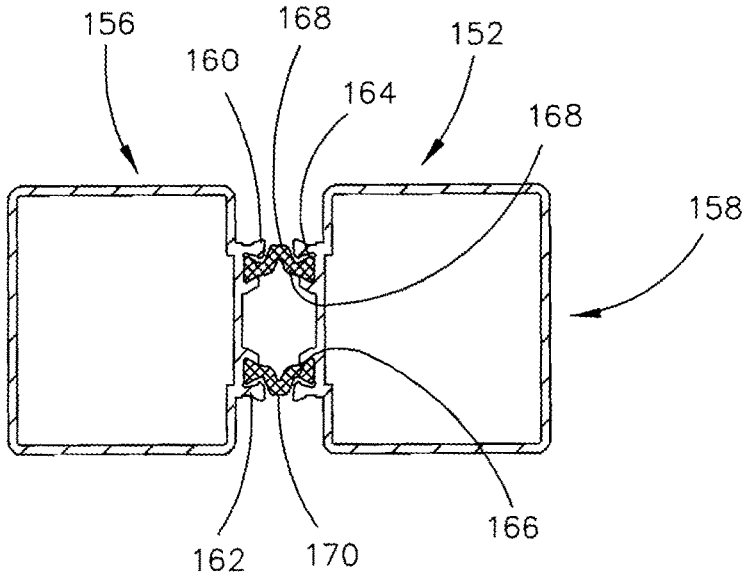
FIG. 9 is a sectional view of the door jamb of this invention.

The numeral 10' refers to a second elongated aluminum extrusion which is identical to extrusion 10. Identical structure or elements, which as extrusion 10' will be identified with "'". The extrusions 10 and 10' may be extruded at the same time or extruded at different times. The aluminum extrusions 10 and 10' are then positioned with respect to one another as seen in FIG. 4. An elongated connector member 48, which is comprised of a non-metallic, non-thermally conductive member, is longitudinally slit into channels 46 and 42 for the entire length of the extrusions 10 and 10'. An elongated connector member 50, which is identical to connector member 48, is longitudinally slit into channels 46' and 42 for the entire length of the extrusions 10 and 10'. As seen in FIG. 4, the connector members 48 and 50 have enlarged ends which prevent the separation of the extrusions 10 and 10'. The connector member 48 and 50, which are flexible, permit a small amount of movement between the extrusions 10 and 10' but maintain the spacing between the extrusions 10 and 10'. It should be noted that the extrusions 10 and 10' are filled with a foam insulation material as seen in FIG. 8.

Figure 5:
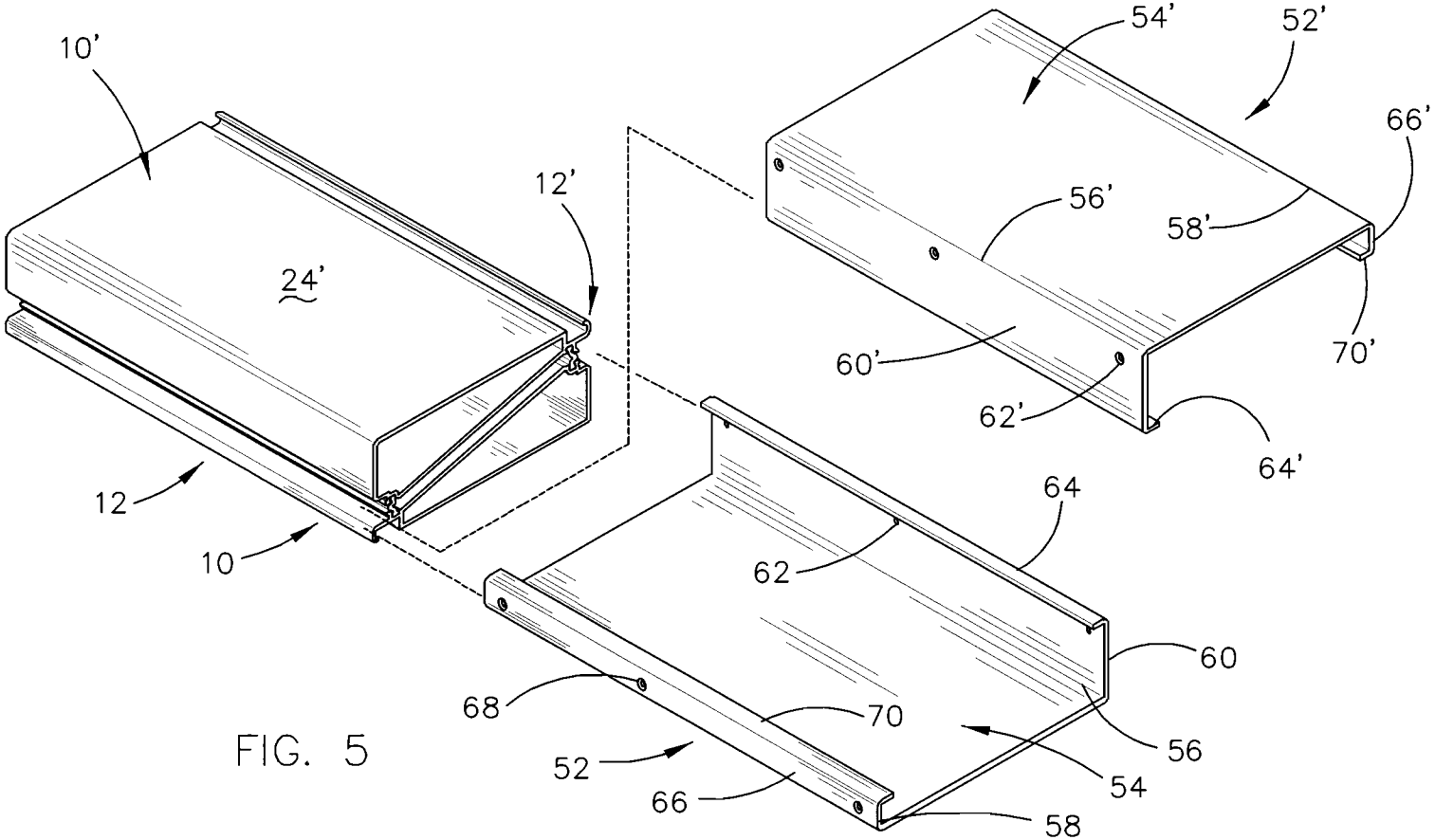
FIG. 5 is a partial exploded perspective view of one of the stiles of this invention.
Figure 6:
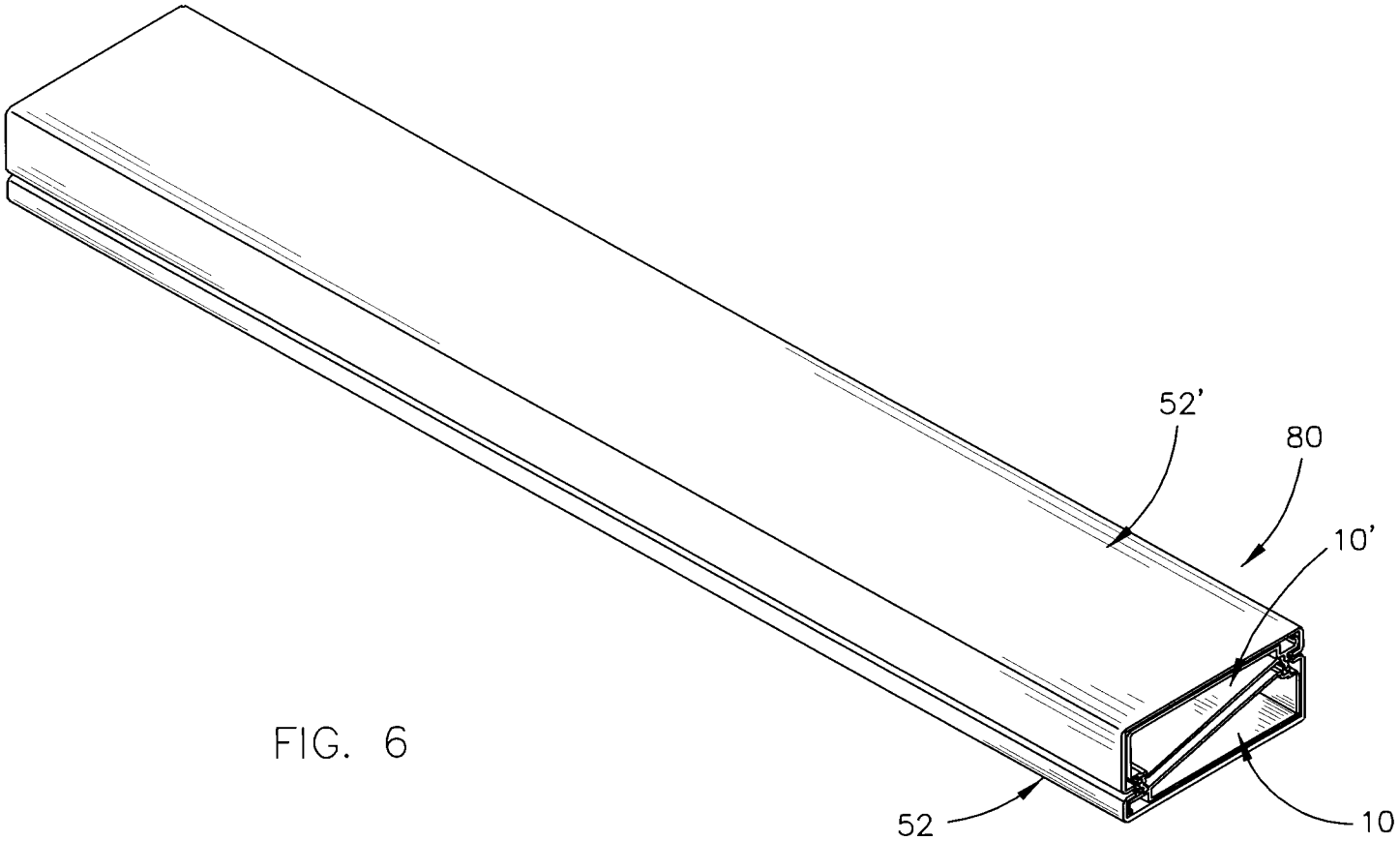
FIG. 6 is a perspective view of one of the stiles of this invention.
Figure 7:
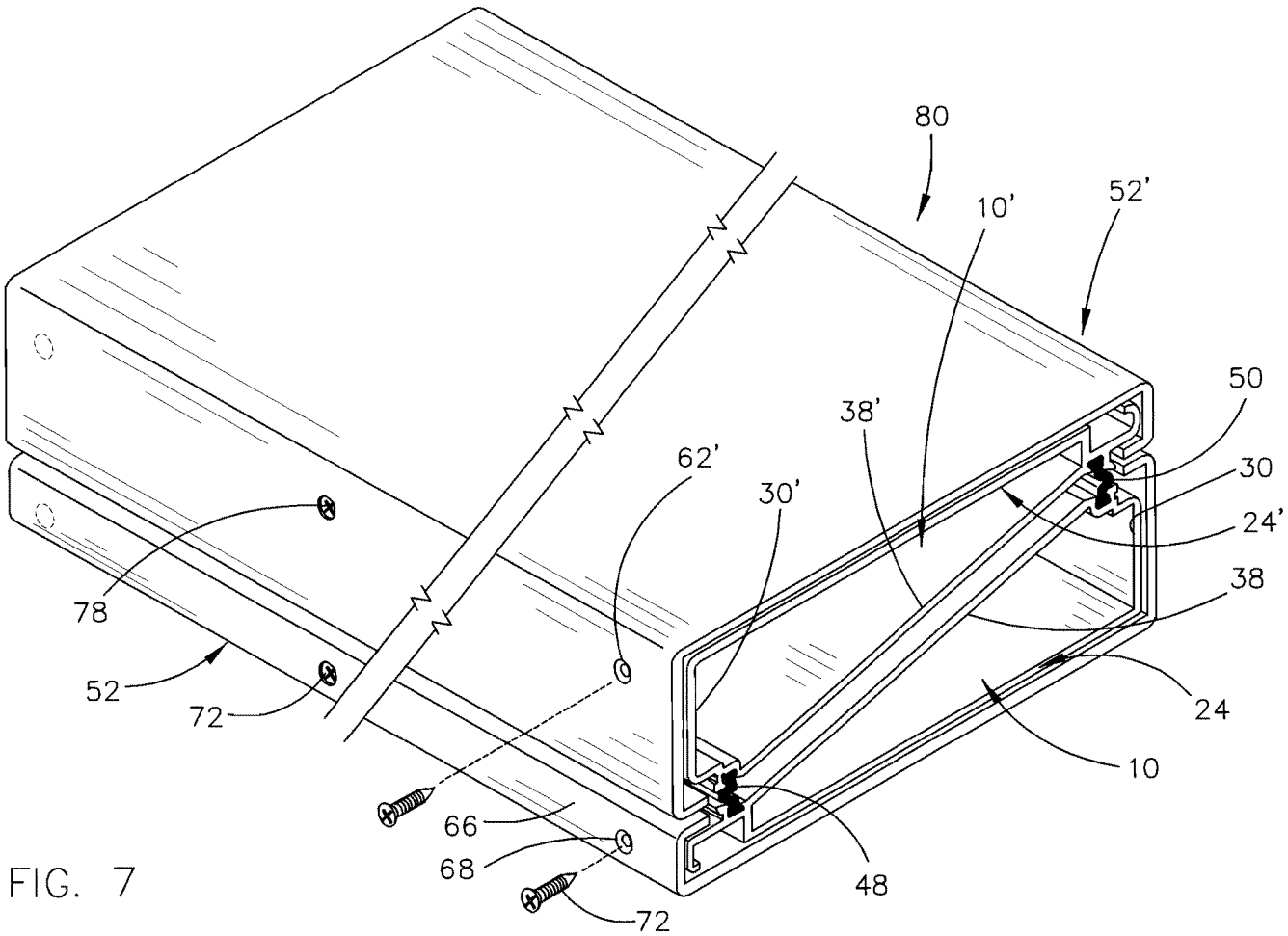
FIG. 7 is a partial perspective view of one of the stiles of this invention.

The numeral 52 refers to an elongated steel skin while the numeral 52' refers to a steel skin which is identical to steel skin 50. Identical features on steel skin 52' will be identified with "'". Skin 52 includes a wall member 54 having ends or sides 56 and 58. Wall member 60 extends transversely from end 56 of wall member 54 and has a plurality of spaced-apart screw openings 62 formed therein as seen in FIG. 5. A flange 64 extends transversely from the outer end of wall member 60. A wall member 66 extends transversely from end 58 of wall member 54 and has a plurality of spaced-apart screw openings 68 formed therein. A flange 70 extends transversely from the outer end of wall member 66.

The steel skins 52 and 54 are longitudinally slipped over the extrusions 10 and 10' so as to embrace the extrusions 10 and 10'. When so positioned, screws 72 are extended through the screw openings 68 in wall member 66 of skin 52 and self-tap into wall member 16 of extrusion 10. Screws 74 are then extended through the screw openings 62 in wall member 60 of skin 52 and self-tap into wall member 30 of extrusion 10.

After the skin 52 has been attached to extrusion 10, screws 76 are extended through screw openings 68' in wall member 66' and self-tap into wall member 16' of extrusion 10'. Screws 78 are then extended through screw openings 62' in wall member 60' and self-tap into wall 30' of extrusion 10'.

When the skins 52 and 52' have been attached to extrusions 10 and 10', they provide a thermal break between the outer skins 52, 52' and the extrusions 10, 10'. As seen in FIG. 8, the flange 70 of skin 52 is spaced from the flange 64' of skin 52' and the flange 64 of skin 52 is spaced from the flange 70' of skin 52'. As also seen in FIG. 8, wall members 38 and 38' are spaced-apart. Inasmuch as the connectors 38 and 40 are comprised of a non-metallic, non-thermally conductive material, there is a thermal break between extrusions 10 and 10' and there is a thermal break between the steel skins 52 and 52'.

The assembled extrusions 10, 10' and the skins 52 and 52' will be described as being an assembly 80. The elongated assembly 80 will be cut to lengths for use in the hinge stile 3, the lock stile 4 and the lower rail 6. One end of the lower rail 6 is welded to the lower end of the hinge stile 3 and the other end of the lower rail 6 is welded to the lower end of the lock stile 4.

Figure 11:
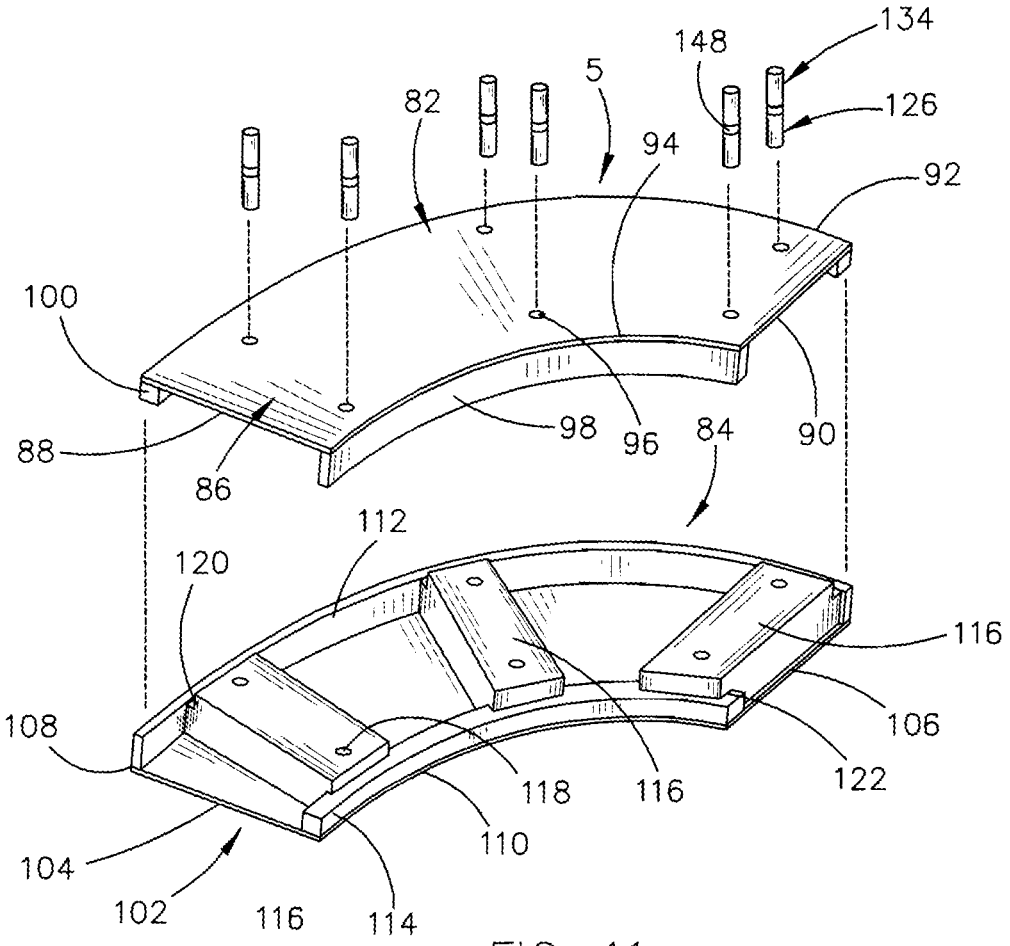
FIG. 11 is an exploded perspective view of the upper rail of the door of this invention.

The arched or curved top rail 5 includes an exterior rail member 82 and an interior rail member 84. Rail member 82 includes a curved flat panel 86 having ends 88 and 90, an upper edge 92 and a lower edge 94. A plurality of openings 96 are formed in panel 86. A curved plate 98 is welded to the panel 86 at the lower edge 94 of panel 86 as seen in FIG. 11. A curved bar 100 is welded to panel 86 at upper edge 92 of panel 86 as seen in FIG. 11.

The interior rail member 84 includes a curved flat panel 102 having ends 104 and 106, an upper edge 108 and a lower edge 110. A curved plate 112 is welded to panel 102 at upper edge 108 of panel 102 as seen in FIG. 11. A curved bar 114 is welded to panel 102 at lower edge 110 of panel 102 as also seen in FIG. 11.

A plurality of spaced-apart blocks or spacers 116 are positioned between panels 86 of rail member 82 and panel member 102 of rail member 84. Each of the blocks 116 have openings 118 formed therein. The openings 118 register with the openings 124 formed in panel 102. Each of the blocks 116 have elongated notches 120 and 122 formed therein. The numeral 126 refers to a steel pin having ends 128 and 130. The pin 126 has internal threads 132 formed therein which extend into the pin 126 from end 130. The numeral 134 refers to a steel pin having ends 136 and 138. The pin 134 has internal threads 140 formed therein which extend into the pin 134 from end 138.

The numeral 142 refers to a threaded nylon connector having threaded sections 144 and 146 therein which are separated by a collar 148. The rail members 82 and 84 are secured together as will now be described. The ends 128 of the pins 126 are inserted into the openings 118 in the blocks 116 until the ends 128 of the pins 126 are positioned in the openings 124 in rail member 84. The ends 128 of the pins 126 are then welded to the panel 102 of rail member 84. The threaded sections 144 of the connectors 142 are then threaded into the threads 132 of the pins 126 until the collars 148 engage the ends 130 of the pins 126. The steel pins 134 are then threaded onto the threaded sections 146 of the connectors 142 until the ends 138 of the pins 134 engage the collars 148 of the connectors 142.

Figure 12:
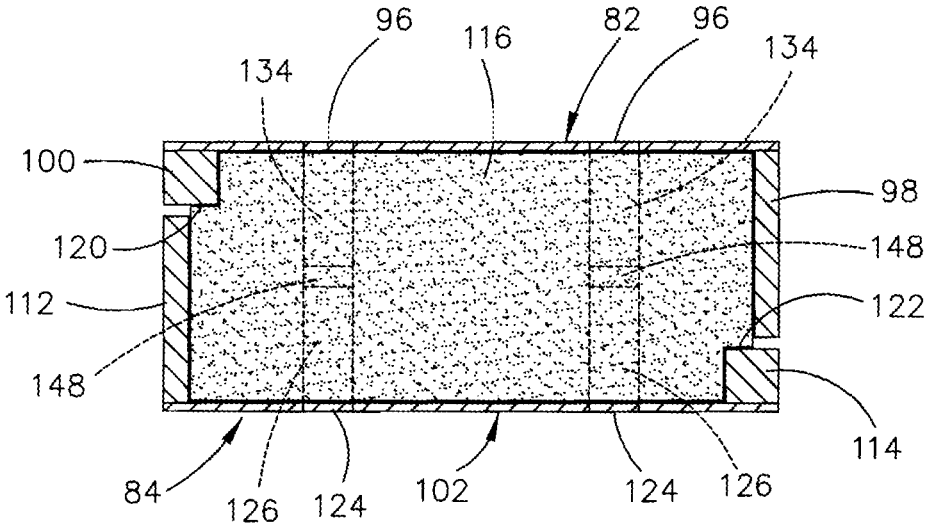
FIG. 12 is a sectional view of the upper rail of FIG. 11.
Figure 14:
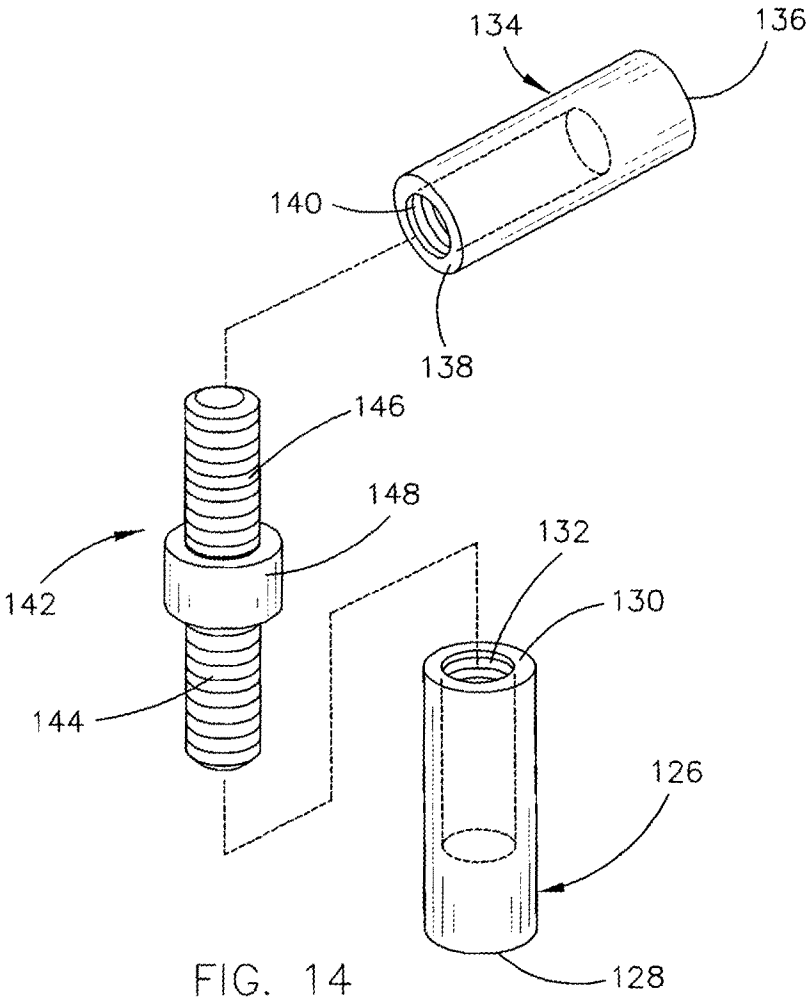
FIG. 14 is an exploded perspective view of one of the fasteners of FIG. 13.
Figure 13:
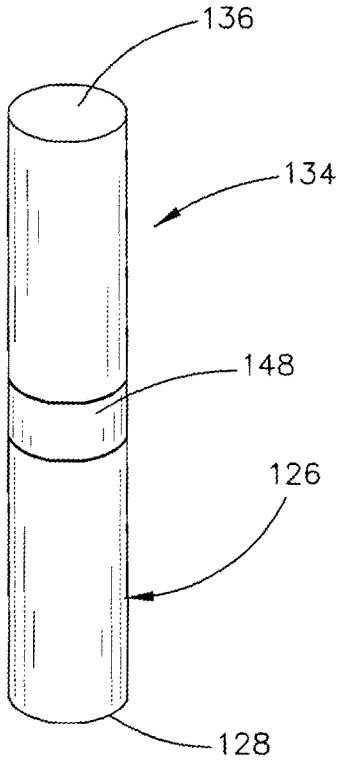
FIG. 13 is a perspective view of one of the fasteners of FIGS. 11 and 12.

The rail member 82 is then positioned adjacent the rail member 84 so that the openings 96 in panel 86 register with the ends 136 of the pins 134. The rail member 82 is then moved towards the rail member so that the ends 136 of the pins 134 are received by the openings 96. The ends 136 of the pins 134 are then welded to the panel 86. As seen in FIG. 12, there is no metal contact between the rail members 82 and 84 thereby creating a thermal break between the rail members 82 and 84. The nylon connectors 142 secure the rail members 84 and 84 together with the non-metallic and non-thermally conductive connectors 142 acting as a thermal break between the rail members 82 and 84. Inasmuch as the intermediate rail 7 has the same construction as top rail 5, it will not be described in detail.

The arched or curved intermediate rail 7 has the same components as the top rail 5 and is assembled in the same manner as top rail 5. In some cases, the intermediate rail will not be used since it is an optional feature.

Although it is preferred that the doors 1 and 1' have an arched top rail, a straight top rail could be used. If a straight top rail is used, the straight top rail would have the same components as the stiles 3 and 4 and the bottom rail 6. Although it is preferred that the intermediate rail 7 be arched or curved, a straight intermediate rail could be used. If a straight intermediate rail is used, the straight intermediate rail would have the same components as the stiles 3 and 4 and the bottom rail 6.

The door jamb 2 also provides a thermal break. For purposes of description, door jamb 2 will be described as including a vertically disposed first side jamb member 150, an arched upper jamb member 152 and a vertically disposed second side jamb member 154. Inasmuch as the jamb members 150, 152 and 154 have identical cross-sections, only the first side jamb member 150 will be described in detail.

The first side jamb member 150 includes an elongated extruded aluminum exterior tube 156 and an elongated extruded aluminum interior tube 158. The inner side of tube 156 has a pair of spaced-apart and elongated channels 160 and 162 formed therein. The outer side of tube 158 has a pair of spaced-apart and elongated channels 164 and 166 formed therein which register or align with the channels 160 and 162 respectively. A non-metallic, non-thermally conductive connector 170 has its ends received in channels 160 and 164. A non-metallic, non-thermally conductive connector 170 has its end received in channels 162 and 166. The tubes 156 and 158 are filled with a foam insulating material 172 and 174 respectively.

Figure 10:
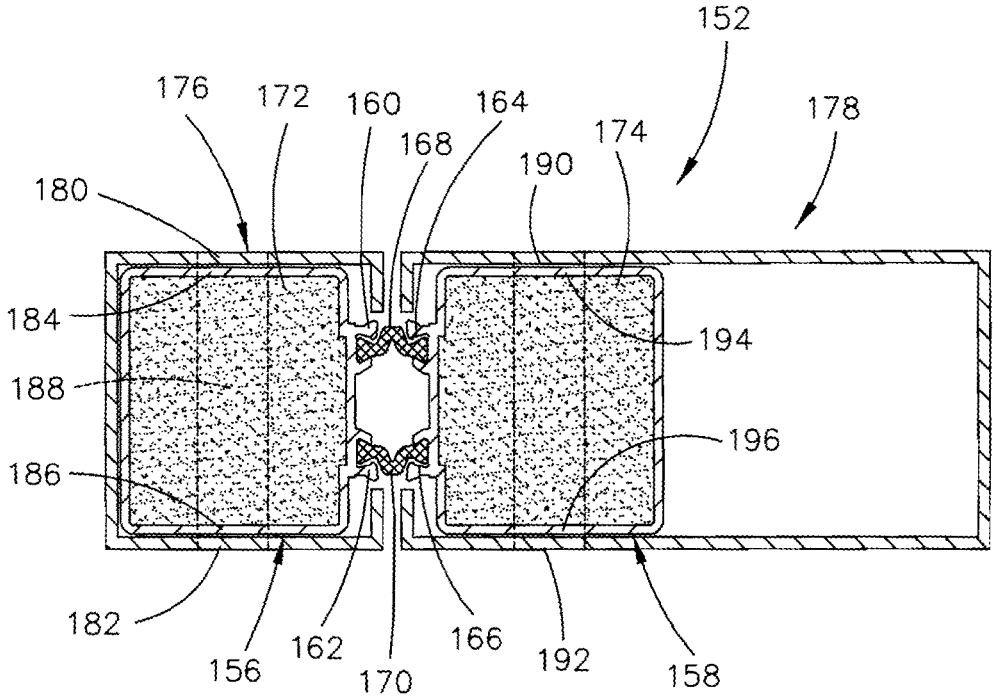
FIG. 10 is a sectional view similar to FIG. 9 except that the metal skins have been positioned on the structure of FIG. 9.

Elongated metal skins 176 and 178 embrace tubes 156 and 158 respectively as seen in FIG. 10. Skin 176 has pin holes 180 and 182 formed therein which register with holes 184 and 186 which are formed in tube 156. The numeral 188 refers to a pin which has one end thereof positioned in holes 184 and 180. The other end of pin 188 is positioned in holes 186 and 182. The ends of pin 188 are welded to skin 176 thereby securing skin 176 to tube 156. Skin 178 has pin holes 190 and 192 formed therein which register with holes 194 and 196 formed in tube 158. The numeral 198 refers to a pin which has one end positioned in holes 194 and 190. The other end of pin 198 is positioned in holes 196 and 192. The ends of pin 198 are welded to skin 178 thereby securing skin 178 to tube 158.

The stile 3 of door 1 is hingedly secured to side jamb member 150 by hinges 200. The stile 3' is hingedly secured to side jamb member 154 by hinges.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A metal door, comprising:

a vertically disposed hinge stile having an upper end, a lower end, an inner side, an outer end, a front side and a rear side;

a vertically disposed lock stile having an upper end, a lower end, an inner end, an outer end, a front side and a rear side;

a top rail extending between said upper ends of said hinge stile and said lock stile with said top rail having a first end, a second end, an upper end, a lower end, a front side and a rear side;

a bottom rail extending between said lower ends of said hinge stile and said lock stile with said bottom rail having a first end, a second end, an upper end, a lower end, a front side and a rear side;

each of said hinge and lock stiles comprising:

(a) a vertically disposed first aluminum extrusion having:

(1) a front wall with first and second ends;

(2) a first end wall, having first and second ends, extending transversely rearwardly from said first end of said front wall;

(3) a second end wall, having first and second ends, extending transversely rearwardly from said second end of said front wall;

(4) a rear wall, having first and second ends, extending between said second end of said first end wall and said second end of said second end wall;

(5) said front wall, said first end wall, said second end wall and said rear wall defining a generally triangular-shaped second cavity;

(6) said first cavity having foam insulation therein;

(7) an elongated first channel at said second end of said first end wall;

(8) an elongated second channel adjacent said second end of said rear wall;

(b) a vertically disposed second aluminum extrusion having:

(1) a rear wall with first and second ends;

(2) a first end wall, having first and second ends, extending transversely forwardly from said first end of said rear wall thereof;

(3) a second end wall, having first and second ends, extending transversely forwardly from said second end of said rear wall;

(4) a front wall, having first and second ends, extending between said second end of said first end wall and said second end of said second end wall thereof;

(5) said rear wall, said first end wall, said second end wall and said front wall defining a generally triangular-shaped second cavity;

(6) said first cavity having foam insulation therein;

(7) an elongated first channel at said second end of said first end wall;

(8) an elongated second channel adjacent said second end of said front wall;

said second aluminum extrusion being positioned with respect to said first aluminum extrusion so as to be spaced rearwardly therefrom with said second channel of said second aluminum extrusion being aligned with said first channel of said first aluminum extrusion and so that said first channel of said second aluminum extrusion is aligned with said second channel of said first aluminum extrusion and so that said front wall of said second aluminum extrusion is spaced from said rear wall of said first aluminum extrusion and is parallel thereto;

an elongated first connector having first and second ends;

said first end of said first connector being received in said first channel of said first aluminum extrusion with said second end of said first connector being received in said second channel of said second aluminum extrusion;

an elongated second connector having first and second ends;

said first end of said second connector being received in said second channel of said first aluminum extrusion with said second end of said second connector being received in said first channel of said second aluminum extrusion;

said first and second connectors being comprised of a non-metallic and non-thermally conductive material whereby a thermal break is provided between said first and second aluminum extrusions;

an elongated first steel skin secured to said first aluminum extrusion so as to embrace said first end wall, said front wall and said second end wall thereof;

an elongated second steel skin secured to said second aluminum extrusion so as to embrace said first end wall, said rear wall and said second end wall thereof;

said first and second steel skins being spaced apart so as to create a thermal break therebetween;

said bottom rail being of identical construction to said hinge stile and said lock stile except for the length thereof which is less than the length of said hinge stile and said lock stile; and said top rail having a thermal break created therein between said front side and said rear side thereof.

2. The metal door of claim 1 wherein said top rail comprises:

(a) a vertically disposed front rail member having a first end, a second end, an upper end, a lower end, a front side and a rear side;

(b) a vertically disposed rear rail member having a first end, a second end, an upper end, a lower end, a front side and a rear side;

(c) said front rail member and said rear rail member being secured together in a spaced-apart manner to create a thermal break therebetween; and (d) a foam insulation between said front rail member and said rear rail member.

* * * * *